US007137439B2

(12) United States Patent
Hoshino

(10) Patent No.: US 7,137,439 B2
(45) Date of Patent: Nov. 21, 2006

(54) TANK-INTEGRATED SHROUD, AND METHOD AND JIG FOR MANUFACTURING THE SAME

(75) Inventor: Yoshitake Hoshino, Nishikamo-gun (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/703,222

(22) Filed: Nov. 6, 2003

(65) Prior Publication Data

US 2004/0187808 A1 Sep. 30, 2004

(30) Foreign Application Priority Data

Nov. 7, 2002 (JP) ..... 2002-324117

(51) Int. Cl.
*F28D 1/06* (2006.01)
*F24D 19/02* (2006.01)

(52) U.S. Cl. ..... 165/73; 165/149; 165/76

(58) Field of Classification Search ..... 165/51, 165/916, 121, 125, 140, 76, 78, 149, 122; 123/41.27, 41.31, 41.43, 41.44, 41.49, 41.54, 123/41.5, 41.55; 180/68.1–68.4; 415/215.1, 415/221; 416/189

See application file for complete search history.

(56) References Cited

U.S. PATENT DOCUMENTS 4,441,463 A * 4/1984 Rest et al. ..... 123/41.27
5,971,062 A * 10/1999 Sadr et al. ..... 165/104.32
6,041,744 A * 3/2000 Oota et al. ..... 123/41.49
6,499,956 B1 * 12/2002 Nakamura ..... 416/189
6,523,507 B1 * 2/2003 Schmitz et al. ..... 123/41.55

FOREIGN PATENT DOCUMENTS

JP 63094019 A * 4/1988
JP 08072563 A * 3/1996
JP 09088603 A * 3/1997
JP 2001107732 A * 4/2001
JP 2001234748 A * 8/2001
JP 2001-317357 11/2001

* cited by examiner

*Primary Examiner*—Tho Duong
(74) *Attorney, Agent, or Firm*—Harness, Dickey & Pierce, PLC

(57) ABSTRACT

In a tank-integrated shroud, a shroud body has an air guiding wall having a first surface along which air flows and a second surface opposite to the first surface. The air guiding wall has a looped projection on the second surface. The looped projection forms a recess therein that is recessed from the first surface of the air guiding wall. A tank has an opening at one side. The periphery of the opening is welded to the looped projection of the shroud body, so the tank is integrated with the shroud body. During welding, a part of a welding jig is inserted into the recess of the looped projection.

12 Claims, 4 Drawing Sheets

TANK-INTEGRATED SHROUD, AND METHOD AND JIG FOR MANUFACTURING THE SAME

CROSS REFERENCE TO RELATED APPLICATION

This application is based on Japanese Patent Application No. 2002-324117 filed on Nov. 7, 2002, the disclosure of which is incorporated herein by reference.

FIELD OF THE INVENTION

The present invention relates to a tank-integrated shroud suitable in use for an electric fan, which supplies cooling air to a radiator for cooling an engine, and a method and a jig for manufacturing the tank-integrated shroud.

BACKGROUND OF THE INVENTION

A tank-integrated shroud is for example disclosed in JP-A-2001-317357. A tank, which is used as a resonator, is integrated with a shroud by utilizing a free space around the shroud. Specifically, as shown in FIG. 5, a tank 320*a* has an opening portion 322 on one side. The opening portion 322 is welded to a wall 311*a* of a shroud 310. The wall 311*a* is provided by an air guiding portion 311. Also, a looped projection 312, corresponding to the periphery of the opening portion 322, is formed on the flat wall 311 so that the opening portion 322 is easily welded. However, because the shroud 310 has a generally flat box shape, the air guiding portion 311 is flat.

Regarding the air guiding portion of the shroud, generally, it is preferable to have a bell-mouth shape curving from the peripheral portion of the shroud toward a fan 301 so that air flows smoothly, as shown in FIG. 6. However, when the air guiding portion 311 has the flat shape as of the above-mentioned shroud, the flow of air is likely to be disturbed, as shown in FIGS. 7A and 7B. As a result, an air blow performance is deteriorated. Further, the above construction causes noise problem. FIG. 7A shows an example where a tank volume is small. FIG. 7B shows an example where a tank volume is large.

SUMMARY OF THE INVENTION

The present invention is made in view of the foregoing matter and it is an object of the present invention to provide a tank-integrated shroud, which is capable of properly welding a tank to an air guiding portion having an ideal air-guiding shape. It is another object of the present invention to provide a method and a jig for manufacturing the tank-integrated shroud.

According to a tank-integrated shroud of the present invention, a shroud body has an air guiding wall having a first surface along which air flows and a second surface. The first and second surfaces are opposite to each other. The air guiding wall has a looped projection on the second surface. The looped projection forms a recess that is recessed from the first surface of the air guiding wall. A tank, which has an opening at one side, is integrated with the shroud body such that the periphery of the opening is welded to the looped projection.

Since the recess is formed in the projection, a part of a jig is inserted in the recess when the tank is integrated with the shroud body. Because a pressing force is received by the part of the jig, the shroud body and the tank are securely welded.

Also, the shroud body can be properly supported by the part of the jig. Accordingly, the tank can be welded to the shroud body, which has the ideal shape for guiding air smoothly.

BRIEF DESCRIPTION OF THE DRAWINGS

Other objects, features and advantages of the present invention will become more apparent from the following detailed description made with reference to the accompanying drawings, in which like parts are designated by like reference numbers and in which.

DETAILED DESCRIPTION OF EMBODIMENT

Embodiment of the present invention will be described hereinafter with reference to the drawings.

Figure 1:
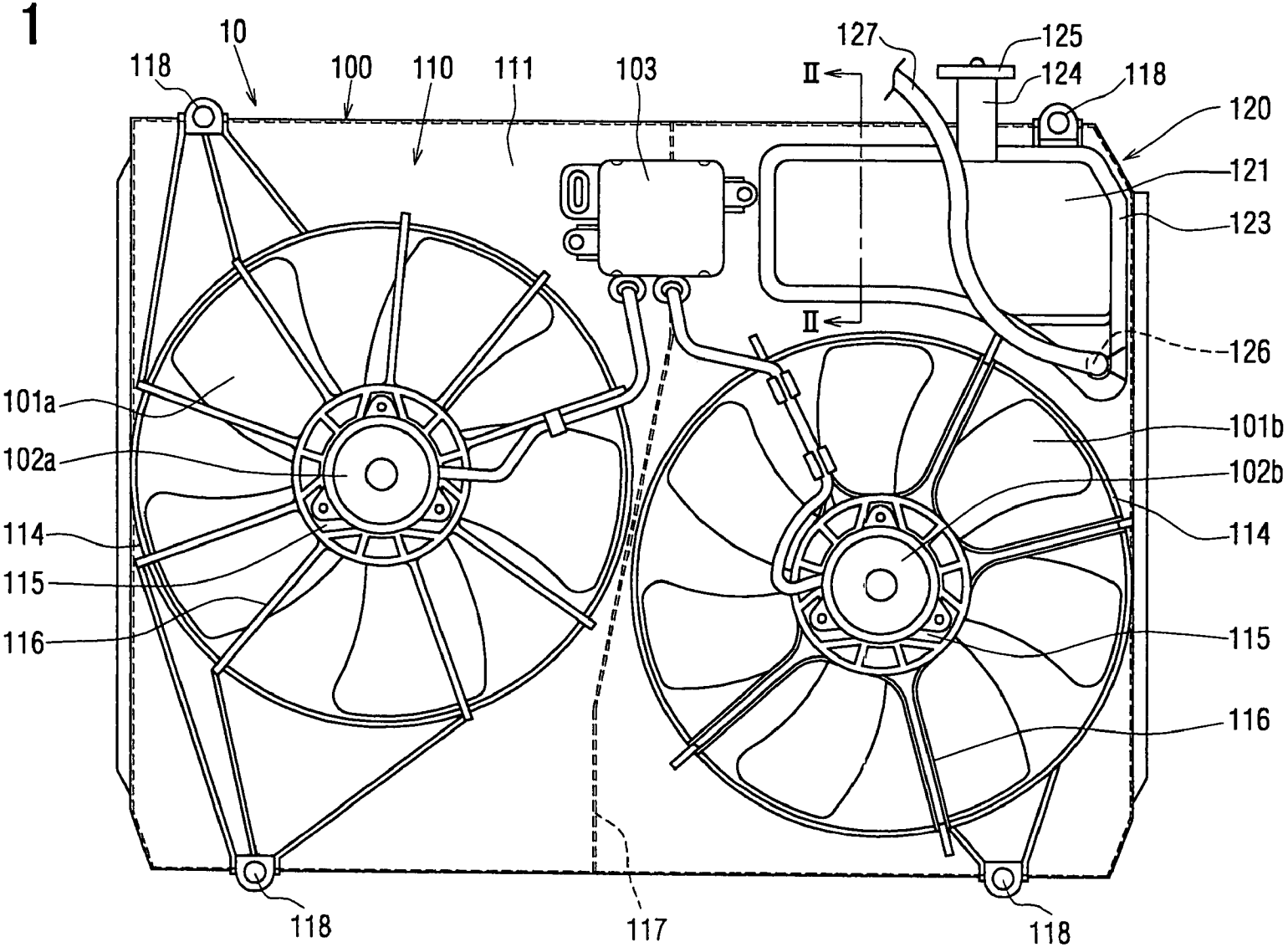
FIG. 1 is a schematic plan view of an electric fan according to the embodiment of the present invention.

A tank-integrated shroud 100 of the present invention is for example employed to an electric fan 10, as shown in FIG. 1. The electric fan 10 includes fans 101*a*, 101*b*, which are respectively driven by motors 102*a*, 102*b*.

The electric fan 10 has fixing portions 118 at corners. The electric fan 10 is fixed to a radiator (not shown) of a vehicle on an engine side at the fixing portions 118. The electric fan 10 functions as a blower for blowing cooling air to a core portion of the radiator. In the embodiment, the electric fan 10 is a drawing-type blower. The electric fan 10 draws air from a grille of the vehicle toward the engine. That is, the air is sucked through the core portion of the radiator toward the fans 101*a*, 101*b*.

The tank-integrated shroud 100 is constructed of a shroud body 110 and a reserve tank (tank, hereafter) 120. The shroud body 110 is made of polypropylene including a glass fiber content of approximately 25% to 30%. The fixing portions 118 and respective portions 111 to 117, which will be described hereafter, are integrally molded by injection molding. The shroud body 110 has a generally rectangular shape to correspond to the core portion of the radiator. The shroud body 110 is provided with ring portions 114 in which the fans 101*a*, 101*b* are arranged, motor holding portions 115 and motor stays 116. The motor holing portions 115 is formed at the center of the ring portions 114. The motor stays 116 radially extend from the motor holding portions 115 and connect to the ring portions 114. The motor holding portions 115 are supported by the motor stays 116.

The motors 102*a*, 102*b* are held by the motor holding portions 115. The fan 101*a*, 101*b* are supported by shafts (not shown) of the motors 102*a*, 102*b*. The motors 102*a*, 102*b* are general DC ferrite motors. The motors 102*a*, 102*b* are connected to a controller 103. The controller 103 changes on/off timing of the power supply to the motors 102*a*, 102*b*, thereby varying an average electric current value. Therefore, the rotation speed of the fans 101*a*, 101*b*, which are directly connected, is changed, to thereby control the air blow volume of the fans 101*a*, 101*b* according to a required cooling power of the radiator.

Figure 2:
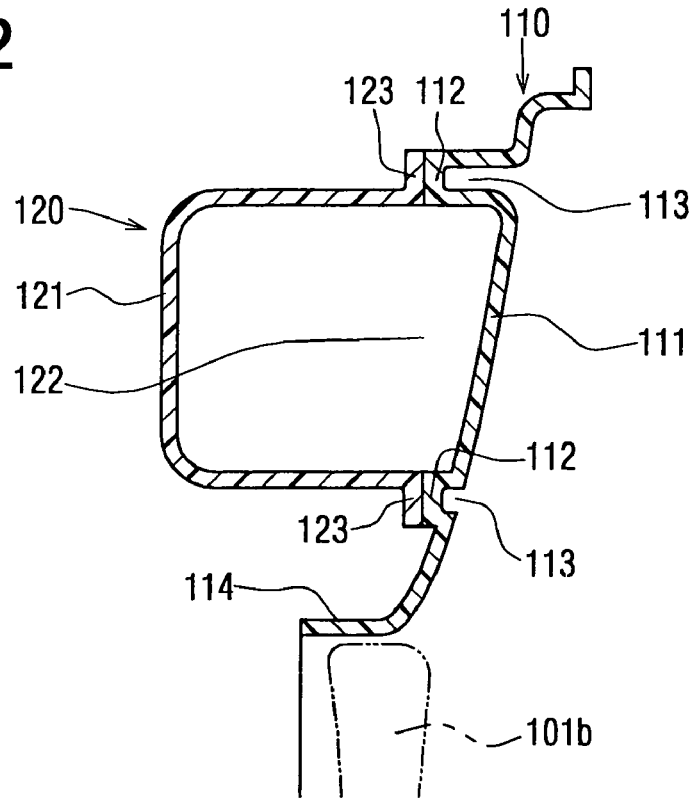
FIG. 2 is a cross-sectional view of a reserve tank integrated with a shroud body taken along line II—II in FIG. 1.

As shown in FIG. 2, the shroud body 110 has a shroud air guiding portion (air guiding wall) 111 extending between a peripheral end of the shroud body 110 (top end in FIG. 1) and the ring portion 114. The guiding portion 111 is gently and smoothly sloped so that the air smoothly flows toward the fans 101*a*, 101*b*. In FIG. 2, air flows on a right side of the guiding portion 111. The shroud body 110 has a separation wall 117 at a substantially middle position of the guiding portion 111. The air flowing area of the fan 101*b* is separated from that of the fan 101*a* by the separation wall 117.

The guiding portion 111 is formed with a looped projection 112 on a side opposite to the air flowing area. In FIG. 2, the projection 112 projects to the left side of the guiding portion 111. Further, the inside of the projection is recessed from the surface of the air guiding portion 111, which faces the air flowing area, thereby forming a recess 113 therein. The recess 113 is formed such that a welding jig 200 (described later) is inserted from the side of the air flowing area during welding. Since the air guiding portion 111 includes a first wall portion between opposing portions of the projection and a second portion extending from a side of one portion of the projection opposite to the first wall portion to continue the gentle and smooth slope of the guiding portion 111 for maintaining its ideal shape for flowing air smoothly, the projection 112 is formed so that the end of the projection 112 has a shape to correspond to a welding surface of the reserve tank 120. In FIG. 2, the end of the projection 112 forms a flat surface. Thus, a dimension of the projection 112 is longer at an upper side than the lower side in FIG. 2.

The reserve tank 120 is made of polypropylene including a glass fiber content of approximately 20%. The reserve tank 120 has a tank body 121 having a substantially rectangular parallelepiped shape. One side of the tank body 121 is open to form an opening portion 122. The periphery of the opening portion 122 extends in a form of flange and forms a welding portion 123 including the welding surface at an end. A water filling port 124 is formed to extend upward from the tank body 121 in a form of tube. A connecting portion 126 is formed to open at a lower position of the tank 120. The tank body 121, the opening portion 122, the water filling port 124 and the connecting portion 126 are integrally molded by injection molding. The reserve tank 120 is integrated with the shroud body 110 by welding the welding portion 123 to the projection 112 of the guiding portion 111.

A cap 125 is fitted to the end of the water filling port 124. The connecting portion 126 is connected to the radiator through a hose 127. Cooling water that overflows from the radiator as the temperature increases is stored in the reserve tank 120. Also, the stored cooling water returns to the radiator, with constriction of the cooling water as the temperature decreases.

Figure 3:
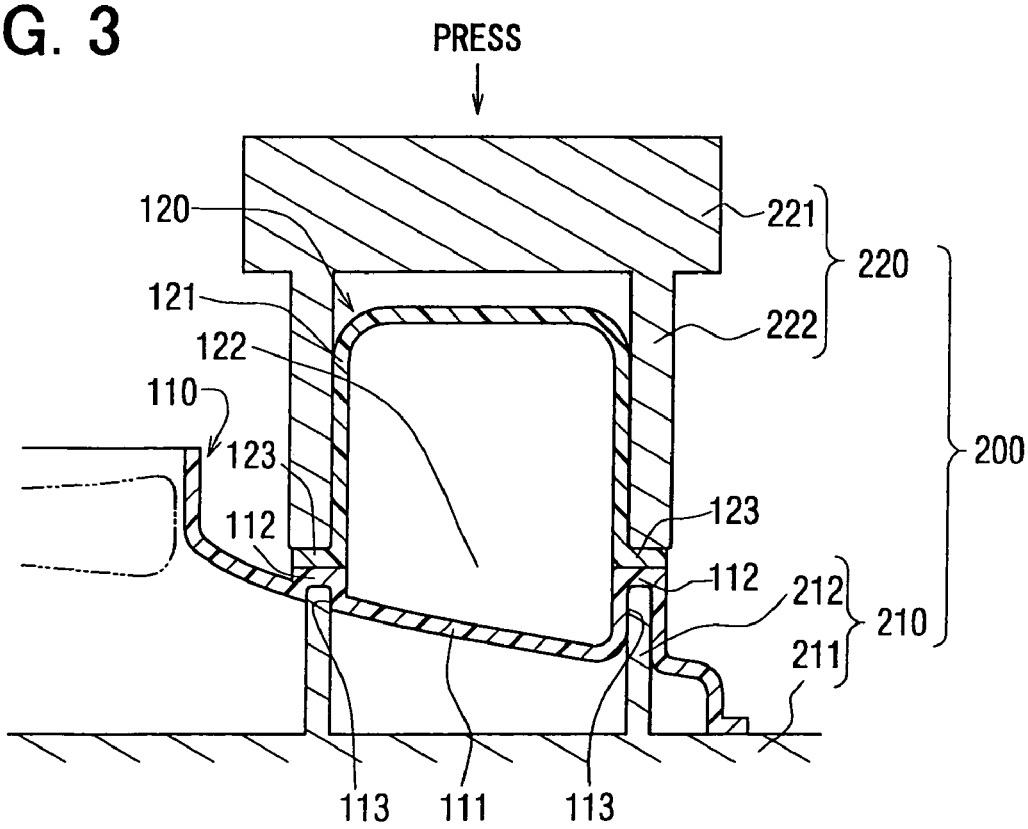
FIG. 3 is a schematic sectional view of a jig unit for explaining a method of welding the reserve tank to the shroud body according to the embodiment of the present invention.

Next, a method of welding the reserve tank 120 will be described. As shown in FIG. 3, a welding jig (jig unit) 200 including a lower jig (first jig) 210 and an upper jig (second jig) 220 is used. The first jig 210 has a base 211 and a receiving portion 212 that projects from the base 211 in a form to correspond to the recess 113 of the shroud body 110. The second jig 220 has a base 221 and a pressing portion 222. The pressing portion 222 projects from the base 221 in a form to correspond to the outer shape of the reserve tank 120. The pressing portion 222 has an end surface. The end surface is formed to be in contact with the flange-shaped welding portion 123. The first jig 210 and the second jig 220 are set such that the receiving portion 212 and the pressing portion 222 are opposed to each other. The second jig 220 is provided to be movable up and down with respect to the first jig 210.

First, in a condition that the second jig 220 is separated from the first jig 210, the shroud body 110 is horizontally placed on the first jig 210. At this time, the receiving portion 212 is inserted in the recess 113 of the projection 112. The reserve tank 120 is set onto the second jig 220 such that the welding portion 123 is in contact with the end surface of the pressing portion 222.

Next, a heating device such as a heater plate (not shown) is placed between the projection 112 and the welding portion 123. Then, the second jig 220 is moved downward, so the projection 112 and the welding portion 123 are respectively melted.

Next, the heater plate is removed. Then, a predetermined pressing force is applied to the second jig 220, so the projection 112 and the welding portion 123 are sandwiched between the pressing portion 222 and the receiving portion 212. As a result, the projection 112 and the welding portion 123 are welded to each other.

Figure 4:
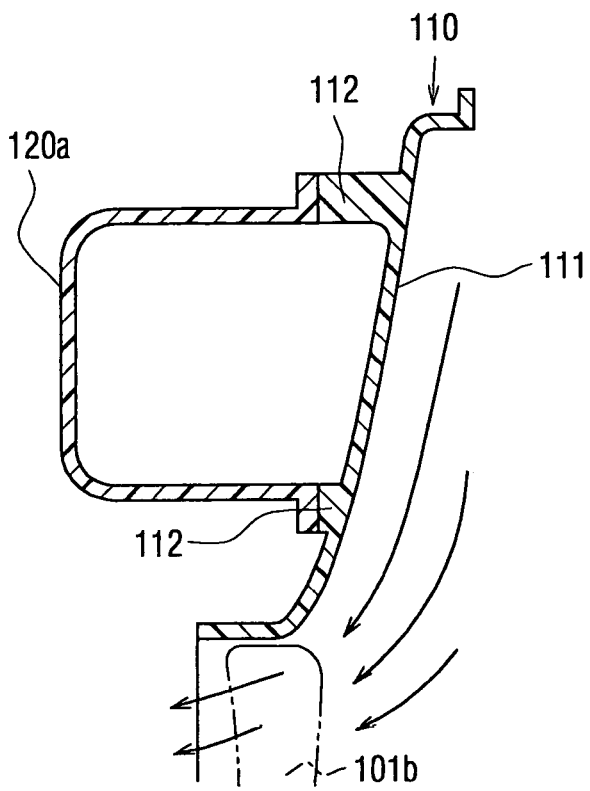
FIG. 4 is a schematic cross-sectional view of a reserve tank and a shroud body as a comparison example with the embodiment shown in FIG. 2.
Figure 5:
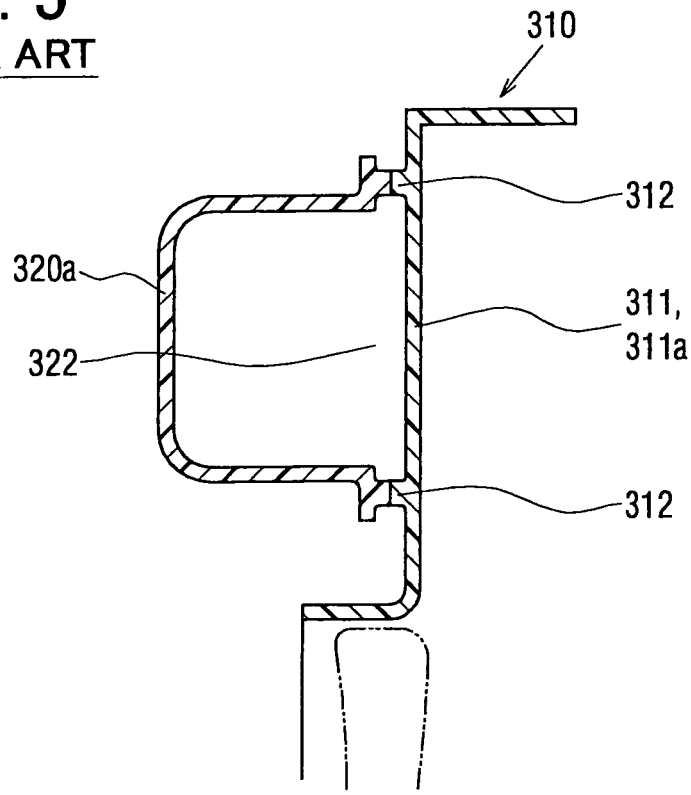
FIG. 5 PRIOR ART
FIG. 5 is a schematic cross-sectional view of a tank integrated-shroud of a prior art.
Figure 6:
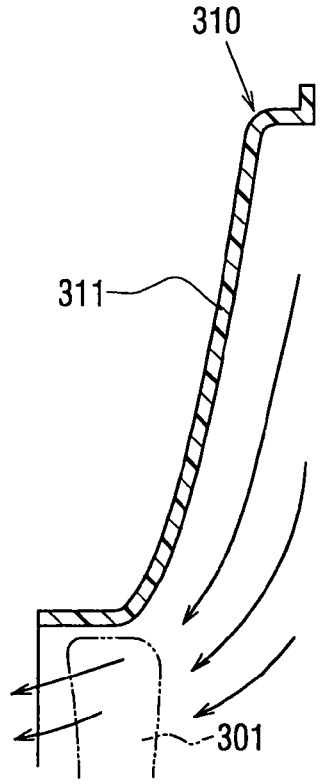
FIG. 6 RELATED ART
FIG. 6 is a cross-sectional view of a part of a shroud having a shape ideal for smoothly guiding air.
Figure 7A:
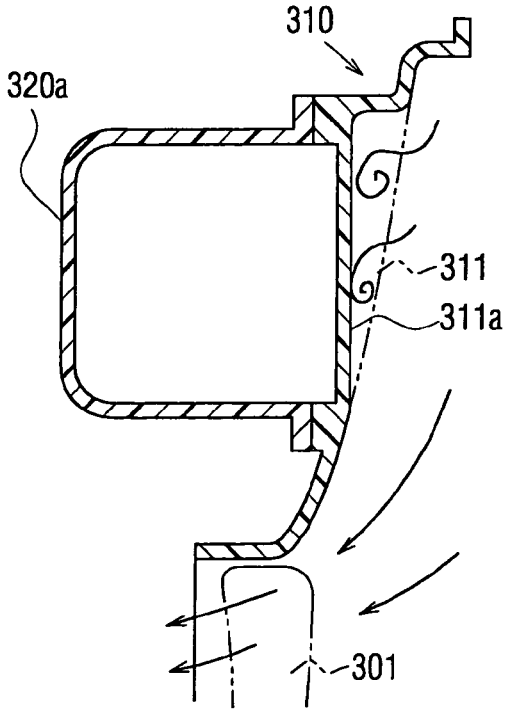
FIG. 7A RELATED ART
FIG. 7A is a schematic cross-sectional view of a tank integrated with a shroud of a related art.
Figure 7B:
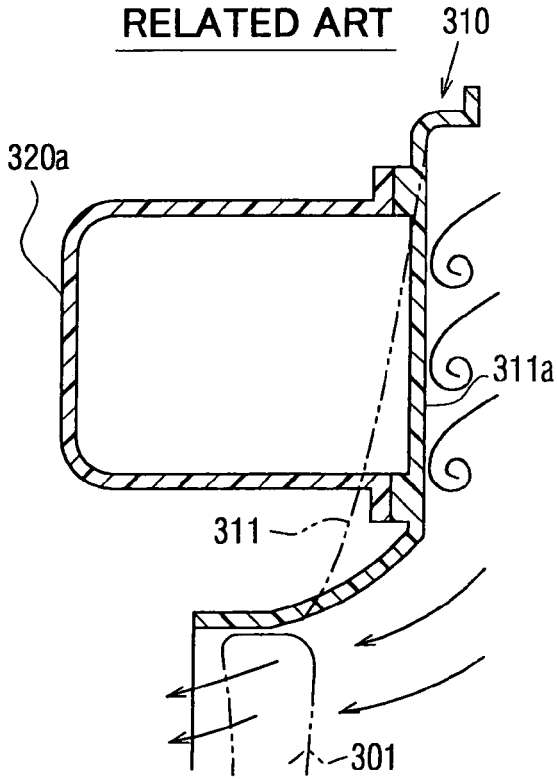
FIG. 7B RELATED ART
FIG. 7B is a schematic cross-sectional view of the tank integrated with the shroud of a related art.

Incidentally, since the guiding portion 111 is sloped to maintain the ideal air guiding shape, the dimension of the projection is different within the looped projection 112. If the recess 113 is not formed in the projection 112 of the shroud body 110, as shown in FIG. 4, the projection 112 may be warped or bend due to the pressing force during the welding, especially at a position where the dimension is relatively large. Further, this may results in loss of the pressing force.

In the embodiment, on the other hand, the recess 113 is formed in the projection 112. Since the receiving portion 212 of the first jig 210 is inserted in the recess 113 of the projection 112, the pressing force of the pressing portion 222 is received by the receiving portion 212. Therefore, the welding portion 123 is properly welded to the projection 112 of the shroud body 110.

Also, the shroud body 110 is properly positioned on the first jig 210 by the receiving portion 212. Therefore, the receiving portion 212 makes the welding work easy.

In this way, the reserve tank 120 for the radiator is properly integrated with the electric fan 10. Therefore, the radiator and the reserve tank are adjacently arranged to each other by utilizing a dead space around the guiding portion 111. With this arrangement, the hose 127 is easily handled.

The tank-integrated shroud 100 of the embodiment can be employed to another fan, in place of the electric fan 10. For example, the tank-integrated shroud can be used for an engine coupling fan.

Regarding the tank integrated with the shroud, it is not limited to the reserve tank for the radiator. For example, the tank can be a tank used for another purpose, such as a washer tank or an oil tank for a power steering.

The present invention should not be limited to the disclosed embodiment, but may be implemented in other ways without departing from the spirit of the invention.

What is claimed is:

1. A tank-integrated shroud comprising:

a shroud body having an air guiding wall having a first surface along which air flows and a second surface, the first and second surfaces opposite to each other, wherein the air guiding wall has a looped projection on the second surface, the looped projection forms a recess therein that is recessed from the first surface, and the looped projection has a flat surface on a protruding end; and a tank portion having an opening at one side, wherein the tank portion is integrated with the shroud body such that the periphery of the opening is joined to the flat surface of the looped projection, wherein:

the looped projection has a first projection portion and a second projection portion;

the air guiding wall includes a first wall portion extending in a smooth sloped direction from the first projection portion to the second projection portion to define a tank space together with the tank portion and the looped projection, in which a fluid is contained, and a second wall portion extending from the second projection portion in the smooth sloped direction from a side of the second projection portion opposite to the first wall portion for guiding air.

2. The tank-integrated shroud according to claim 1, wherein the periphery of the opening and the looped projection are joined by welding.

3. The tank-integrated shroud according to claim 1, wherein the shroud body is arranged such that the air is guided to pass through a radiator, and the tank portion is disposed to communicate with the radiator for storing a cooling water of the radiator therein.

4. The tank-integrated shroud according to claim 1, wherein the periphery of the opening of the tank portion has a flange having a flat surface to correspond to the flat surface on the protruding end of the looped projection.

5. The tank-integrated shroud according to claim 4, wherein a width of the flat surface of the flange of the tank portion is approximately equal to a width of the flat surface of the protruding end of the looped projection.

6. The tank-integrated shroud according to claim 1, wherein the looped projection is provided at two ends of the first wall portion of the air guiding wall in a slope direction.

7. The tank-integrated shroud according to claim 4, wherein the flat surface of the flange of the tank portion and the flat surface of the protruding end of the looped projection are approximately perpendicular to a protruding direction of the looped projection.

8. The tank-integrated shroud according to claim 1, wherein the first wall portion faces the opening of the tank portion.

9. A tank-integrated shroud comprising:

a shroud body, which includes an air guiding wall for guiding air, and a receiving portion for receiving a fan; and a tank portion having an opening opened at one side in cross-section, wherein:

the tank portion is joined to the air guiding wall to define a tank space in which a fluid is contained;

the air guiding wall includes a first wall portion extending substantially in a slope direction and facing the opening of the tank portion, protrusion portions protruding respectively from two end portions of the first wall portion in the slope direction toward a peripheral end of the opening of the tank portion and joined to the peripheral end of the opening, and a second wall portion extending from one of the protrusion portions in the slope direction to the receiving portion;

the second wall portion extends substantially in the same slope direction as the first wall portion; and each of the protrusion portions has a jig-receiving recess at a side opposite to a protruding end of the protrusion portion, and has a wall thickness approximately equal to a wall thickness of at least one of the first wall portion and the second wall portion.

10. The tank-integrated shroud according to claim 9, wherein:

the protrusion portions each have a flat surface at the protruding end;

the flat surface of the protrusion portion is joined to a flat surface of the peripheral end of the opening;

the protrusion portions protrude in a protruding direction; and the flat surfaces of the protrusion portions and the peripheral end of the opening are substantially perpendicular to the protruding direction.

11. The tank-integrated shroud according to claim 9, wherein the second wall portion extends from one end of the first wall portion to have a continuously extending air-guiding surface in the slope direction.

12. The tank-integrated shroud according to claim 9, wherein:

the air guiding wall guides air to pass through a radiator; and the tank space communicates with an inner space of the radiator.

* * * * *